US008387210B2

(12) United States Patent
Sawa

(10) Patent No.: US 8,387,210 B2
(45) Date of Patent: Mar. 5, 2013

(54) AUTOMATIC DOOR CLOSING HINGE AND DOUBLE SWING DOOR STRUCTURE

(75) Inventor: Takashi Sawa, Yamanashi (JP)

(73) Assignees: Sawa Corporation, Kitatsuru-gun (JP); Takashi Sawa, Kitatsuru-gun (JP); Takashi Yamaguchi, Kitatsuru-gun (JP)

( * ) Notice: Subject to any disclaimer, the term of this patent is extended or adjusted under 35 U.S.C. 154(b) by 477 days.

(21) Appl. No.: 12/734,668

(22) PCT Filed: Nov. 27, 2007

(86) PCT No.: PCT/JP2007/073282

§ 371 (c)(1), (2), (4) Date: May 14, 2010

(87) PCT Pub. No.: WO2009/069237

PCT Pub. Date: Jun. 4, 2009

(65) Prior Publication Data

US 2010/0263289 A1 Oct. 21, 2010

(51) Int. Cl.
*E05F 3/20* (2006.01)

(52) U.S. Cl. ..... 16/50; 16/54; 16/310; 16/313

(58) Field of Classification Search ..... 49/381, 49/384, 386, 397, 236, 237, 238; 16/54, 16/50, 313–314, 352, 318, 330, 303, 310
See application file for complete search history.

(56) References Cited

U.S. PATENT DOCUMENTS 1,200,538 A * 10/1916 Smith et al. ..... 16/303
2,118,950 A * 5/1938 Stannard ..... 16/54
2,127,327 A * 8/1938 De Millar ..... 16/54
2,164,358 A * 7/1939 Stannard ..... 16/54
2,456,537 A * 12/1948 Seaman et al. ..... 16/54
4,100,646 A * 7/1978 Schubeis ..... 16/54

(Continued)

FOREIGN PATENT DOCUMENTS

JP 09184354 A * 7/1997
JP 10-088899 A 4/1998

(Continued)

OTHER PUBLICATIONS

International Search Report dated Feb. 26, 2008, issued on PCT/JP2007/073282.

*Primary Examiner* — Chuck Y. Mah
(74) *Attorney, Agent, or Firm* — Edwards Wildman Palmer LLP

(57) ABSTRACT

An automatic door closing hinge is configured in such a manner that first balls (43) are engaged with a first cam groove (35) formed on an outer peripheral surface of an operating rod in a cylinder (2) at opposed positions so as to have a substantially V-shape at opposed positions thereof, the first balls (43) are engaged with a compression ring (4) urged downward by a compression coil spring (5), the movement of the first balls (43) with respect to the first cam groove (35) is in conjunction with the movement of the compression ring, second balls (65) are engaged with a second cam groove (36) formed under the first cam groove (35) and having substantially the same shape as the first cam groove (35), the second balls (65) are engaged with the piston (6), the movement of the second balls (65) with respect to the second cam groove (36) is in conjunction with the movement of the piston, and air on the lower side of the piston (6) in the cylinder is gradually flowed out according to the movement of the piston.

10 Claims, 5 Drawing Sheets

U.S. PATENT DOCUMENTS

| | | | | | |
|---|---|---|---|---|---|
| 4,391,020 | A | * | 7/1983 | Hsu | 16/314 |
| 4,485,522 | A | * | 12/1984 | Chen | 16/54 |
| 4,788,746 | A | * | 12/1988 | Idler | 16/297 |
| 4,829,628 | A | * | 5/1989 | Vuksic | 16/54 |
| 6,205,619 | B1 | * | 3/2001 | Jang | 16/352 |
| 6,658,694 | B2 | * | 12/2003 | Wang | 16/50 |
| 2003/0229965 | A1 | * | 12/2003 | Wang | 16/54 |
| 2004/0068833 | A1 | | 4/2004 | Sawa | |
| 2004/0250377 | A1 | * | 12/2004 | Park | 16/50 |

FOREIGN PATENT DOCUMENTS

| | | | | |
|---|---|---|---|---|
| JP | 11-303499 | A | | 11/1999 |
| JP | 2000-136669 | A | | 5/2000 |
| JP | 2002-303072 | A | | 10/2002 |
| JP | 3713448 | | | 10/2002 |
| JP | 2005-113682 | A | | 4/2005 |
| JP | 2006214190 | A | * | 8/2006 |
| WO | WO 9954583 | A2 | * | 10/1999 |

* cited by examiner

AUTOMATIC DOOR CLOSING HINGE AND DOUBLE SWING DOOR STRUCTURE

TECHNICAL FIELD

The present invention relates to an automatic door closing hinge having a shock-absorbing function achieved by an air damper and a double swing door structure having the automatic door closing hinge.

BACKGROUND ART

In the related art, an automatic door closing hinge configured to rotate an opened door in a closing direction automatically using a restoring force of a coil spring and provided with a shock-absorbing function for absorbing a shock applied when the door is closed using a hydraulic cylinder is known and, in recent years, an automatic door closing hinge configured to absorb a shock with an air damper instead of the hydraulic cylinder is proposed. The automatic door closing hinge includes a type, for example, configured in such a manner that a piston is stored and arranged in a cylinder provided on one of a pair of vanes, and an operating rod which is fixed at an upper portion to the other vane is arranged within the cylinder, balls disposed so as to roll over a predetermined position of the piston and projecting from an inner periphery are engaged with a cam groove being formed on an outer periphery of a lower portion of the operating rod and having an inclined portion, the piston is moved forward and backward corresponding to the movement of the ball with respect to the inclined portion of the cam groove, and a shock is absorbed by an air cushion action in the cylinder by the returning operation of the piston when the door is closed (see JP-A-2002-303072 and JP-A-2005-113682).

DISCLOSURE OF INVENTION

Incidentally, the automatic door closing hinge configured to absorb a shock with the air damper has superior features such that a smooth shock absorption is achieved without contaminating the periphery with oil leakage and so on. However, the automatic door closing hinge described above is configured to be used for outward-opening or inward-opening doors, that is, for one-side opening doors, and cannot be installed on double swing doors which are opened inward and outward. Therefore, the automatic door closing hinge configured to absorb a shock with the air damper which can be installed on the double swing doors which can be opened inward and outward is being called for.

In view of such problem as described above, it is an object of the present invention to provide an automatic door closing hinge configured to absorb a shock with an air damper which allows installation on double swing door which is opened inward and outward, and a double swing door structure provided with the automatic door closing hinge.

The automatic door closing hinge of the present invention includes: a cylinder; an operating rod attached to one end of the cylinder so as to be rotatable and restricted from moving in the longitudinal direction; a first cam groove formed on an outer peripheral surface of the operating rod in the cylinder so as to have a substantially V-shape at opposed positions thereof; first balls disposed in engagement with the first cam groove at opposite positions; a compression ring engaged with the first balls and moved in the longitudinal direction in the cylinder in conjunction with the movement of the first balls with respect to the first cam groove; a compression coil spring disposed between the compression ring and an upper end portion of the cylinder for urging the compression ring toward the other end of the cylinder; a second cam groove formed on the outer peripheral surface of the operating rod in the cylinder so as to have a substantially V-shape at opposed position thereof and disposed under the first cam groove with upper and lower ends being aligned with those of the first cam groove; second balls disposed in engagement with the second cam groove at opposed positions thereof; a piston engaged with the second balls and moved in the longitudinal direction in the cylinder in conjunction with the movement of the second balls with respect to the second cam groove; and an air damper unit configured to flow out air in the cylinder on the other end side with respect to a bottom portion of the piston gradually according to the movement of the piston toward the other end.

Also, the automatic door closing hinge according to the present invention includes: a cylinder; an operating rod attached to one end of the cylinder so as to be rotatable and restricted from moving in the longitudinal direction; a first cam groove including two substantially V-shaped grooves formed on an outer peripheral surface of the operating rod in the cylinder so as to oppose to each other; two first balls engaged respectively with the first cam groove so as to oppose to each other; a compression ring engaged with the first balls and moved in the longitudinal direction in the cylinder in conjunction with the movement of the first balls with respect to the first cam groove; a compression coil spring disposed between the compression ring and an upper end portion of the cylinder for urging the compression ring toward the other end of the cylinder; a second cam groove including two substantially V-shaped grooves provided on the outer peripheral surface of the operating rod in the cylinder so as to oppose to each other and disposed under the first cam groove with upper and lower ends being aligned with those of the first cam groove; two second balls engaged respectively with the second cam groove and disposed so as to oppose to each other; a piston engaged with the second balls and moved in the longitudinal direction in the cylinder in conjunction with the movement of the second balls with respect to the second cam groove; and an air damper unit configured to flow out air in the cylinder on the other end side with respect to a bottom portion of the piston gradually according to the movement of the piston toward the other end.

The automatic door closing hinge according to the present invention is characterized in that the first cam groove and the second cam groove of the substantially V-shape are respectively formed continuously in a circular shape.

The automatic door closing hinge according to the present invention is characterized in that the difference of elevation between the upper and lower ends of the second cam groove is formed to be longer than the difference of elevation between the upper and lower ends of the first cam groove.

The automatic door closing hinge according to the present invention is characterized in that an air distribution hole is provided on a bottom portion of the piston, the air distribution hole includes a large diameter portion on the other end side of the cylinder, a small diameter portion on the one end side, and a valve plate between the large diameter portion and the small diameter portion, the valve plate is capable of forming a gap communicating from one end side to the other end side between the large diameter portion and the valve plate and closing the small diameter portion, and an adjustable screw portion being capable of adjusting the size of the air flow channel formed between a male thread and a female thread by the strength of screwing is provided at the other end of the cylinder.

A double swing door structure which allows opening and closing inward and outward according to the present invention includes the automatic door closing hinge installed on a door supporting portion or on a door, and is characterized in that a receiving hinge to be attached to the automatic door closing hinge is installed on a door or a door supporting portion. The door supporting portion is, for example, a column, a door frame, and the like as needed.

According to the present invention, when the door is opened inward, the first and second balls move relatively with respect to one of the inclined portions of the substantially V-shaped portions of the first and second cam grooves. When the door is opened outward, the first and second balls move relatively with respect to the other inclined portion of the substantially V-shaped portions of the first and second cam grooves. Therefore, the double swing door which can be opened and closed inward and outward can be automatically closed with the compressed coil spring, and the shock of the door closing operation of the both swing door can be absorbed by an action of air cushion.

In addition, by forming the respective first and second cam grooves of the substantially V-shape continuously in the circular shape, the manufacturing process is simplified.

Also, by forming the difference of elevation between the upper and lower ends of the second cam groove to be longer than that of the first cam groove, the capacity of the air trap is increased, so that the shock-absorbing function of the door-closing operation by the action of the air cushion can be enhanced.

Also, by configuring the valve plate of the air distribution hole on the bottom portion of the piston so as to form the gap communicating from one end side to the other end side between the large diameter portion and the valve plate and be capable of closing the small diameter portion and, in addition, by providing the adjustable screw portion which is capable of adjusting the size of the air flow channel by the strength of the screwing, smooth opening operation when opening the door is secured, and the action of the air cushion can be adjusted to an adequate degree easily, and the stabilization of the degree of the action of the air cushion is achieved.

BEST MODES FOR CARRYING OUT THE INVENTION

Figure 1:
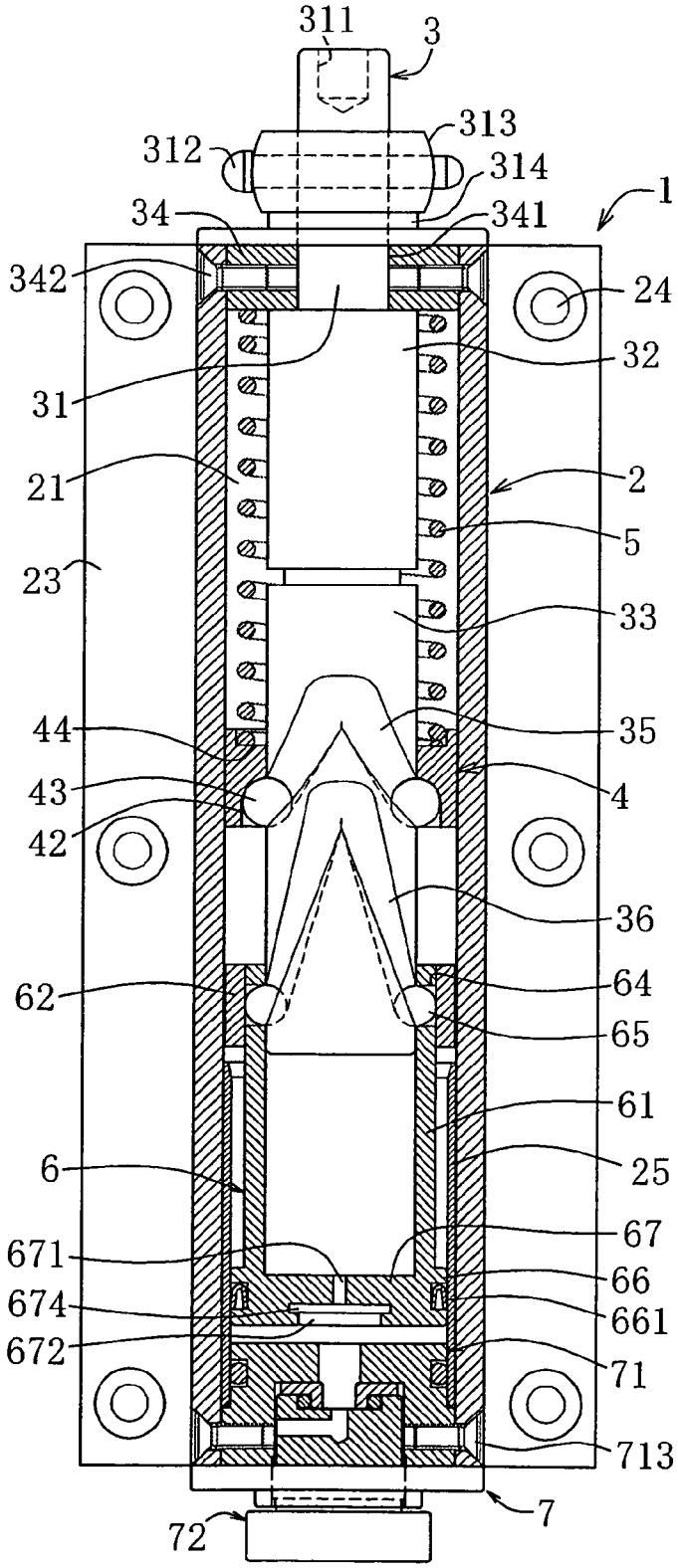
FIG. 1 is an explanatory drawing partly in vertical cross section of an automatic door closing hinge showing a state of the automatic door closing hinge corresponding to a state of door-opened according to an embodiment of the present invention.

Referring now to the drawings, an embodiment of the present invention will be described.

An automatic door closing hinge 1 according to this embodiment includes a cylinder 2, an operating rod 3 rotatably attached to the cylinder 2 so as to project partly outward from an upper end side of the cylinder 2, a compression ring 4 formed into a short cylindrical shape arranged on an outer periphery of the operating rod and inside the cylinder 2, a compression coil spring 5 arranged on an upper side of the compression ring 4 and inside the cylinder 2, a piston 6 arranged on a lower side of the compression ring 4 inside the cylinder 2, and an air adjusting portion 7 provided on a lower end side of the cylinder 2, as shown in FIG. 1 to FIG. 5.

The cylinder 2 has a hollow portion 21 of a substantially cylindrical shape, and is formed with a depressed groove 22 at front and rear positions of the interior surface thereof so as to extend respectively in the vertical direction. A rectangular mounting panel 23 is integrally formed on a back surface side of the cylinder 2 so as to project sideward to the left and right, and the cylinder 2 can be attached to a column, a door frame, and the like by inserting a flat countersunk head screw or the like through a mounting hole 24 of the mounting panel 23. A cylindrical hermetic ring 25 is fitted into and fixed to a lower portion in the hollow portion 21.

The operating rod 3 includes a small diameter portion 31 provided at a substantially upper portion, and large diameter portions 32, 33. A, mounting hole 311 of a hexagonal shape in plan view is formed on an upper end of the small diameter portion 31, a projecting portion 313 is provided at a substantially center of the small diameter portion 31 so as to penetrate through a mounting pin 312 in the lateral direction, and a loosely fitting ring 314 which absorbs a shock is provided on the outer periphery of the small diameter portion 31 so as to be capable of idling under the projecting portion 313. The small diameter portion 31 is inserted into an inserting hole 341 of an upper cap 34 fixed to an upper end of the hollow portion 21 with a flat countersunk head screw 342, and the loosely fitting ring 314 to be pressed from above by the projecting portion 313 is brought into abutment with an upper surface of the upper cap 34. In this state, an upper end surface of the upper large diameter portion 32 is arranged in the vicinity of a lower surface of the upper cap 34, the loosely fitting ring 314 and the upper end surface of the large diameter portion 32 are caught by the upper and lower surfaces of the upper cap 34, so that the vertical movement of the operating rod 3 is restricted.

Cam grooves 35, 36 continuing in a circular shape in plan view are formed in zigzag on an outer peripheral surface of the lower large diameter portion 33, the cam grooves 35, 36 each have an upper end at a center front portion and are formed from the center front position obliquely downward toward the left and right respectively along the outer peripheral surface, and respectively have lower ends at side center positions on the sides shifted from the front center position by 90° leftward and rightward in a state corresponding to the state of the door-opened in FIG. 1. Then, the cam grooves 35, 36 are each formed along the outer peripheral surface from side center positions which become lower ends to a back center position obliquely upward, and have an upper end at the back center position, whereby the upper end and the lower ends of the cam grooves 35 and 36 are formed at corresponding positions. In other words, the cam grooves 35, 36 are each formed into an inverted V-shape in front view and back view and into a V-shape in side views in a state corresponding to door-opened, and vice versa in the state corresponding to door-closed. The length of the upper cam groove 35 is shorter than the length of the lower cam groove 36, and the difference of elevation between the upper end and the lower end of the cam groove 36 is larger than the difference of elevation between the upper end and the lower end of the cam groove 35.

Figure 2:
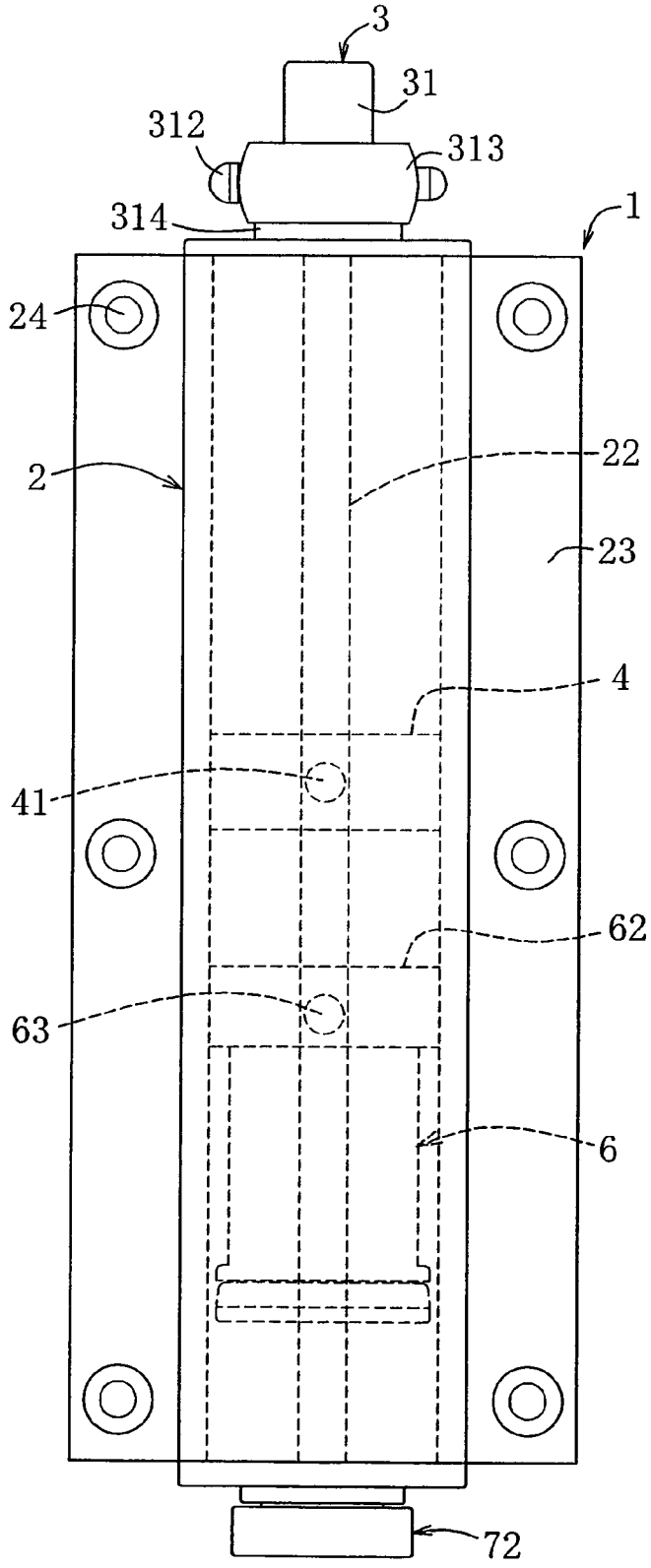
FIG. 2 is a front view showing the automatic door closing hinge in FIG. 1.
Figure 3:
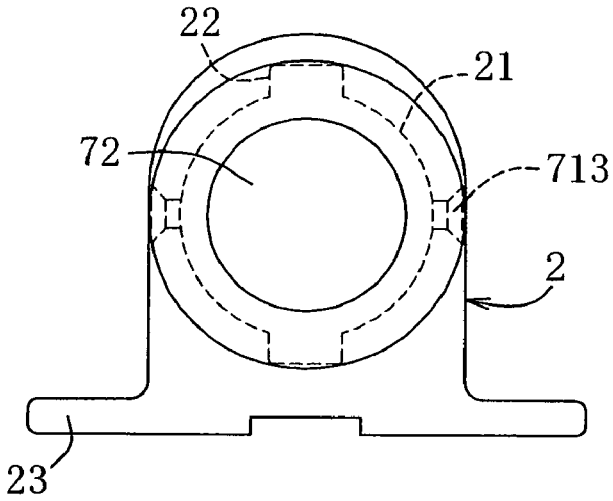
FIG. 3 is a bottom view showing the automatic door closing hinge in FIG. 1.

The compression ring 4 is provided with a pin 41 projecting outward at respective center positions of the front and back in FIG. 1 and FIG. 2, and the pin 41 is engaged with the depressed groove 22 on the inner surface of the cylinder 2. By the pin 41 moving upward and downward while engaging the depressed groove 22, the compression ring 4 is capable of moving upward and downward without rotating. In addition, the compression ring 4 is formed with spherical depressions 42 formed into a substantially semispherical shape at butted positions between an inner peripheral surface and a lower end surface at left and right side center positions in FIG. 1, and two balls 43 are disposed in engagement with the spherical depressions 42 and the upper cam groove 35 of the operating rod 3 respectively so as to be capable of rolling. The balls 43 are constantly positioned at left and right side center positions in FIG. 1 even when the operating rod 3 is rotated by the engagement with the spherical depressions 42 of the compression ring 4 which cannot rotate. Then, when the operating rod 3 is rotated from the state shown in FIG. 1 to the state shown in FIG. 5 by an external force, the balls 43 move along the inclination of the cam groove 35, and are moved from the lower end to the upper end of the cam groove 35 with respect to the cam groove 35, so that the compression ring 4 is moved upward. The butted positions between the inner peripheral surface and the upper end surface of the compression ring 4 are cut out into an L-shape in a circular shape to form a depressed portion 44 having a lower level than the upper end surface.

The compression coil spring 5 is provided around the outer peripheries of the large diameter portion 32 and the upper portion of the large diameter portion 33 of the operating rod 3, and the lower end thereof is placed on a lower surface of the depressed portion 44 of the compression ring 4, while the upper end thereof is in abutment with the lower surface of the upper cap 34. When the compression ring 4 is moved upward by the rotation of the operating rod 3 by the external force described above, the compression coil spring 5 is compressed by the upward movement of the depressed portion 44. In contrast, when the external force is removed, the compression ring 4 is moved downward by the depressed portion 44 urged downward by the compression coil spring 5 being restored and expanded, the balls 43 are moved from the upper end to the lower end of the cam groove 35 with respect to the cam groove 35, and the operating rod 3 is rotated from the state shown in FIG. 5 to the state shown in FIG. 1.

The piston 6 has a substantially bottomed cylindrical shape, and an outer fitting ring 62 having a short cylindrical shape is fitted on an upper end of a peripheral wall 61. The upper end of the peripheral wall 61 of the piston 6 and the outer fitting ring 62 are joined by a pin 63 projecting outward at respective center positions of the front and back in FIG. 1 and FIG. 2. The pin 63 is engaged with the depressed groove 22 on the inner surface of the cylinder 2, and the pin 63 moves upward and downward while engaging the depressed groove 22, so that the piston 6 and the outer fitting ring 62 are configured to be able to move upward and downward without rotation. In addition, engaging holes 64 are formed so as to penetrate therethrough at the left and right side center positions thereof respectively in the vicinity of the upper end of the peripheral wall 61 of the piston 6, and two balls 65 are disposed so as to be capable of rolling in engagement with depressions formed by engaging holes 64 and an inner peripheral surface of the outer fitting ring 62 on the outer periphery of the peripheral wall 61 and the cam groove 36 on a lower side of the operating rod 3. The balls 65 are constantly positioned at the left and right center positions shown in FIG. 1 even when the operating rod 3 is rotated by the engagement between the depressions formed of the engaging holes 64 and the outer fitting ring 62 and the cam groove 36. Then, when the operating rod 3 is rotated from the state shown in FIG. 1 to the state shown in FIG. 4 by the external force, the balls 65 roll along the inclination of the cam groove 36, and are moved from the lower end to the upper end of the cam groove 36 with respect to the cam groove 36, so that the piston 6 is moved upward. When the external force is removed and the compression coil spring 5 is restored and expanded, the balls 65 move from the upper end to the lower end of the cam groove 36 with respect to the cam groove 36, and the piston 6 moves downward from the state shown in FIG. 4 to the state shown in FIG. 1.

A flange 66 projecting outward is formed at a lower end of the piston 6, and a packing ring 661 is fitted into a peripheral groove having an angular C-shape in cross section formed on the flange 66. The packing ring 661 slides in contact with an inner surface of the hermetic ring 25 of the cylinder 2 in the upward and downward movement of the piston 6. An air distribution hole is provided at a center position of a bottom portion 67 of the piston 6, and the air distribution hole is defined by an upper small diameter portion 671, a lower large diameter portion 672, and an intermediate portion 673 having a larger diameter than the large diameter portion 672 and positioned between small diameter portions 671 and 672. The intermediate portion 673 is provided with a valve plate 674 so as to be movable slightly in the vertical direction. The valve plate 674 closes the large diameter portion 672 with a gap formed partly in the vertical direction and is capable of closing the small diameter portion 671 in the vertical direction. When the piston 6 moves upward, air on the upper side of the bottom portion 67 of the piston flows from the small diameter portion 671, urges the valve plate 674 toward the large diameter portion 672, and flows from the gap formed partly toward a lower side of the bottom portion 67. When the piston 6 moves downward, when allowing air to flow out from an air trap formed in the hollow portion 21 on the lower side of the bottom portion 67 of the piston in FIG. 5, the contact state is maintained by the sliding movement between the packing ring 661 and the hermetic ring 25. Then, the valve plate 674 is urged upward by air and closes the small diameter portion 671 by abutment, so that the hermeticity is ensured, and abrupt flow out of air upward of the bottom portion 67 of the piston is restrained.

Figure 4:
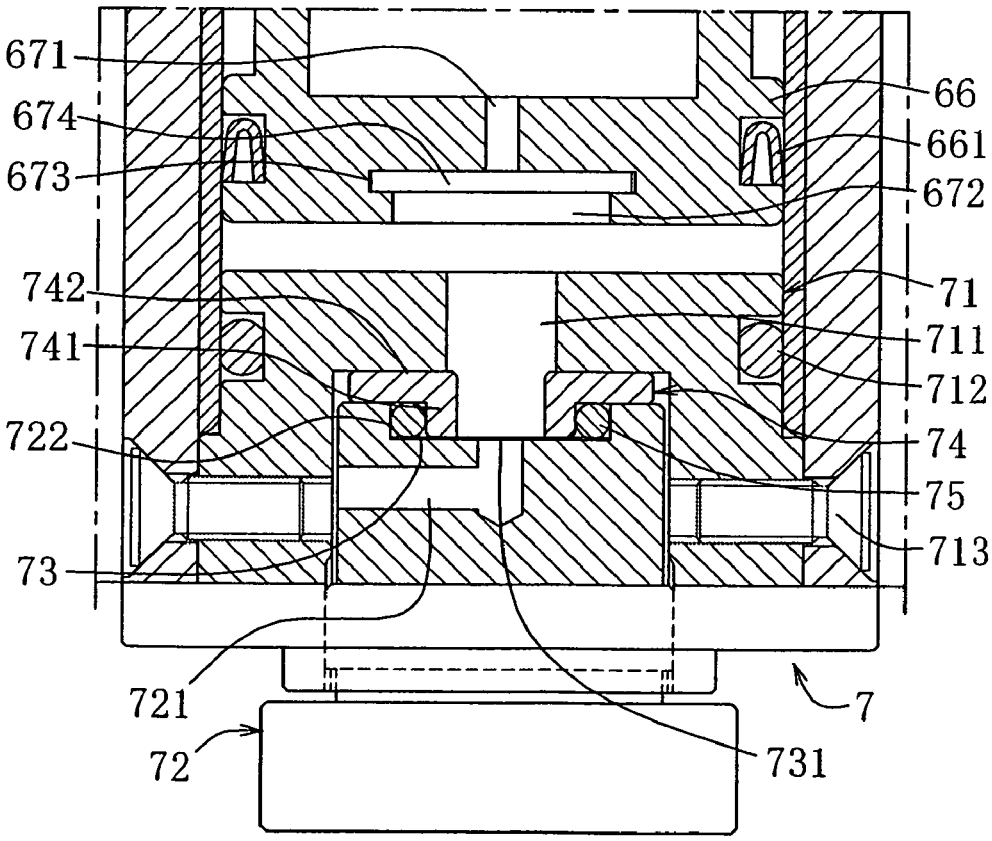
FIG. 4 is an enlarged explanatory drawing showing the periphery of a lower cap of the automatic door closing hinge in FIG. 1.

The air adjusting portion 7 includes a lower cap 71 and an adjustable screw portion 72. As shown in FIG. 4, the lower cap 71 has a substantially short cylindrical shape, and includes an air distribution hole 711 having an upper small diameter portion and a lower large diameter portion formed at a center thereof. The large diameter portion is formed with a female thread on a lower portion of an inner peripheral surface thereof, and is fixed to a lower end of the hollow portion 21 of the cylinder 2 with a flat countersunk head screw 713. An O-ring 712 is fitted into a peripheral groove on an outer peripheral surface of the lower cap 71, and the O-ring 712 is arranged in contact with an inner peripheral surface of a lower portion of the hermetic ring 25. The adjustable screw portion 72 is attached by being screwed into the female thread on the lower portion of the large diameter portion of the air distribution hole 711. An air flow channel 721 in substantially L-shape in cross section is formed from an upper end of the adjustable screw portion 72 to be released from the peripheral surface thereof, and a circular depressed portion 722 is formed on an upper end surface thereof at a position where the air flow channel 721 is released to the upper end. A valve plate 73 having a minute air distribution hole 731 at a center thereof is placed on the depressed portion 722. A ring-shaped spacer 74 having a flange 742 is disposed at an upper end of the large diameter portion of the lower cap 71, and the spacer 74 is arranged with a lower end of a cylindrical portion 741 placed on the valve plate 73 in the depressed portion 722 of the adjustable screw portion 72, and an upper surface of the flange 742 in contact with or in proximity to the upper surface of the large diameter portion. In the depressed portion 722 of the adjustable screw portion 72, an O-ring 75 is fitted into the outer periphery of the cylindrical portion 741 of the spacer 74, and air is restrained from flowing out from between the adjustable screw portion 72 and the spacer 74.

Figure 6:
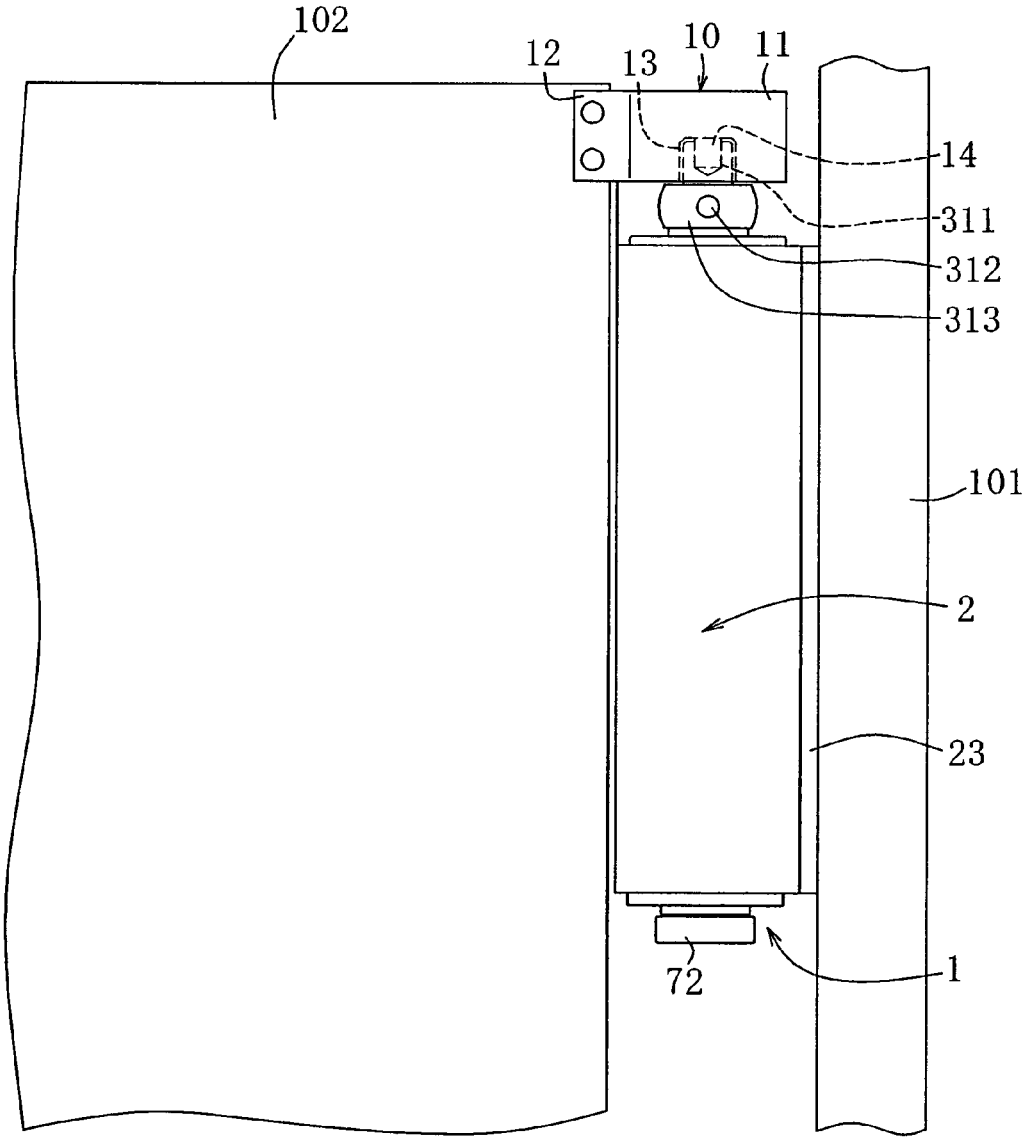
FIG. 6 is a partial front view showing a double swing door structure provided with the automatic door closing hinge in FIG. 1.

As shown in FIG. 6 for example, the automatic door closing hinge 1 is attached to a column 101, by placing the mounting panel 23 of the cylinder 2 to a side surface of the column and inserting a flat countersunk head screw or the like through the mounting hole 24. Also, a receiving hinge 10 is attached to a right upper corner of a door 102 by fixing a vane 12 and the door 102 with a flat countersunk head screw or the like inserted therethrough. A projection 14 being hexagonal in plan view is formed on an upper end of a mounting hole 13 formed on a lower surface of a base member 11 of the receiving hinge 10 so as to project downward therefrom, and the receiving hinge 10 is fixedly attached to the operating rod 3 by inserting an upper end of the operating rod 3 into the mounting hole 12 and fitting the projection 14 to the mounting hole 311 at the upper end of the operating rod 3. In the same manner, the receiving hinge 10 and the automatic door closing hinge 1, or a normal hinge for the double swing doors which are opened inward and outward can be provided on a right lower corner of the door 102 and a column corresponding thereto, and in the latter case, a vacant hinge having no shock-absorbing function or door-closing function may be used.

Figure 5:
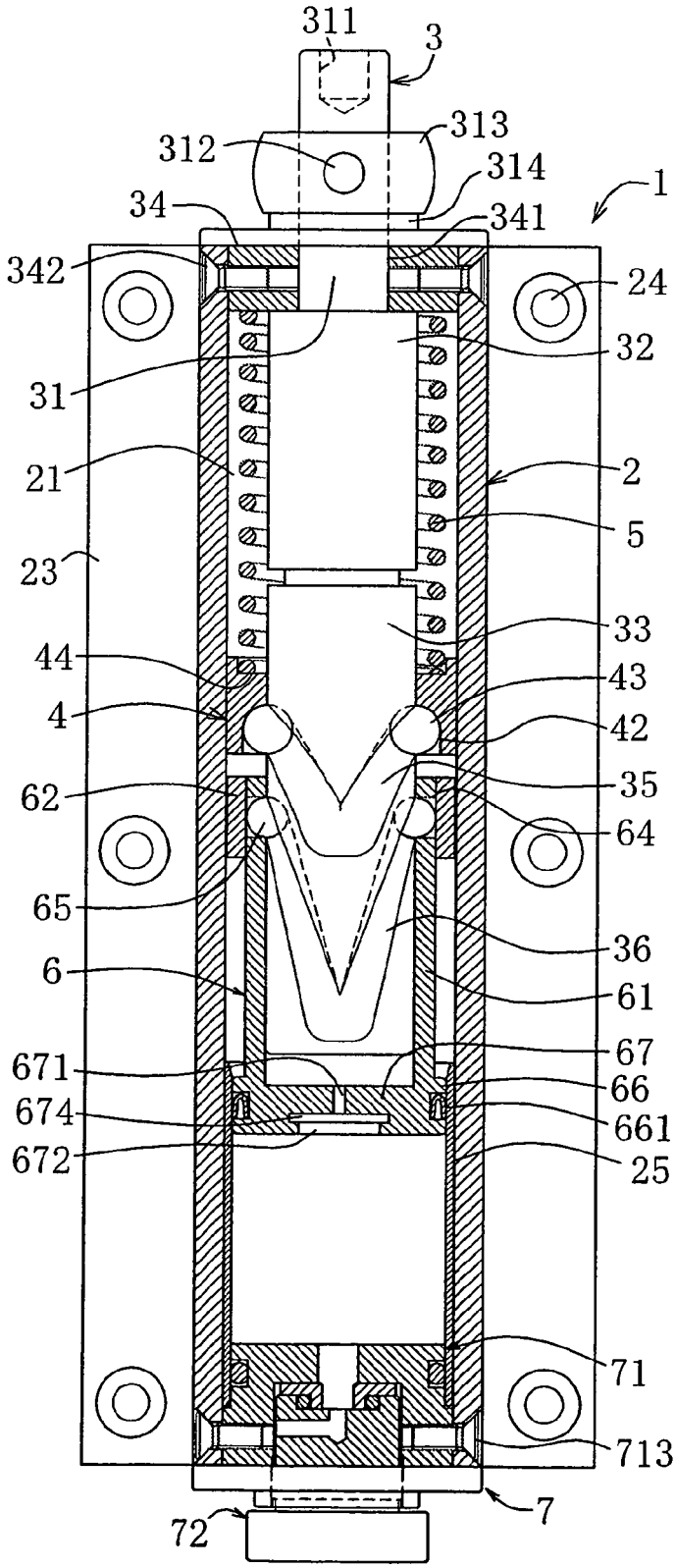
FIG. 5 is an explanatory drawing partly in vertical cross section of the automatic door closing hinge showing a state of the automatic door closing hinge corresponding to a state of door-closed in FIG. 1.

In the door-closed state in FIG. 6, the automatic door closing hinge 1 assumes the state shown in FIG. 1. Then, when the door 102 is opened, the operating rod 3 rotates, and the balls 43, 65 roll to move from the lower ends to the upper ends of the cam grooves 35, 36, and then the compression ring 4 is moved upward to compress the compression coil spring 5 and move the piston 6 upward, so that the door-open state shown in FIG. 5 is assumed. In the upward movement of the piston 6, air between the lower surface of the operating rod 3 and the bottom portion 67 of the cylinder urges the valve plate 674 toward the large diameter portion 672, and flows from the gap between the large diameter portion 672 and the valve plate 674 to the lower side of the bottom portion 67, and air trap is formed between the bottom portion 67 of the cylinder and the lower cap 71.

When a user releases his or her hand from the door 102 and hence the external force is removed, the compression coil spring 5 is restored and expanded, and the compression ring 4 is moved downward, the balls 43, 65 roll to move from the upper ends to the lower ends of the cam grooves 35, 36, and the operating rod 3 rotates while moving the piston 6 downward, so that the state is moved from the one in FIG. 5 to the door-closed state in FIG. 1. In the downward movement of the piston 6, air in the air trap between the bottom portion 67 of the cylinder and the lower cap 71 flows gradually out from the minute air distribution hole 731 of the valve plate 73 and is discharged gradually through the air flow channel 721, the outer peripheral area of the adjustable screw portion 72, a screwed area between the adjustable screw portion 72 and the lower cap 71 to the outside of the cylinder 2. Therefore, a shock-absorbing function by the air cushion is obtained and, accordingly, the lower movement of the piston 6 and the rotation of the operating rod 3 are gently proceeded. The degree of shock absorption by the air cushion can be adjusted by adjusting the strength of the screwing between the adjustable screw portion 72 and the lower cap 71. When it is screwed strongly, the degree of the shock absorption is increased by the flow-out of the air from the minute air distribution hole 731. In contrast, when it is screwed weakly, the air is discharged gradually out of the cylinder 2 at a slightly higher flowing speed from between the upper surface of the large diameter portion of the lower cap 71 and the flange 742 of the spacer 74 or between the spacer 74 and the depressed portion 722 of the adjustable screw portion 72 through the outer peripheral area of the adjustable screw portion 72 and the screwed area between the adjustable screw portion 72 and the lower cap 71 having a widened air flow channel due to the weak screwing in addition to the flow-out of the air from the air distribution hole 731, so that the degree of the shock absorption is lowered.

The present invention is not limited to the embodiment described above, and various modifications are possible. For example, the cam groove 35 and the cam groove 36 may be formed separately at two opposed positions respectively in substantially V-shape. Also, in order to obtain the adequate automatic door closing function and damper function according to the restoring force of the compression coil spring 5 or the flow-out volume of the air, a configuration in which the difference of elevation between the upper and lower ends of the cam groove 36 is set to be longer, or shorter conversely, than that of the cam groove 35, or be substantially equal to each other may be employed. The air damper unit in the present invention may have configurations different from that including the cylinder 2, the piston 6, and the air adjusting portion 7 in the embodiment described above as appropriate. For example, an existing air damper unit as in Patent Documents 1 and 2 may be employed. The air damper unit including the cylinder 2, the piston 6, and the air adjusting portion 7 in the embodiment described above may also be applied to the one-side opening door which is opened only inward or outward.

Industrial Applicability

The present invention can be used as a hinge for a double swing door which is opened inward and outward.

The invention claimed is:

1. An automatic door closing hinge comprising:

a cylinder;

an operating rod attached to one end of the cylinder so as to be rotatable and restricted from moving in the longitudinal direction;

a first cam groove formed on an outer peripheral surface of the operating rod in the cylinder so as to have a substantially V-shape at opposed positions thereof;

first balls disposed in engagement with the first cam groove at opposite positions;

a compression ring engaged with the first balls and movable in the longitudinal direction in the cylinder in conjunction with the movement of the first balls with respect to the first cam groove;

a compression coil spring disposed between the compression ring and an upper end portion of the cylinder for urging the compression ring toward the other end of the cylinder;

a second cam groove formed on the outer peripheral surface of the operating rod in the cylinder so as to have a substantially V-shape at opposed position thereof and disposed under the first cam groove, with upper and lower ends being aligned with those of the first cam groove in the longitudinal direction;

second balls disposed in engagement with the second cam groove at opposed positions thereof;

a piston engaged with the second balls and movable in the longitudinal direction in the cylinder in conjunction with the movement of the second balls with respect to the second cam groove; and an air damper unit configured to flow out air in the cylinder on the other end side with respect to a bottom portion of the piston gradually according to the movement of the piston toward the other end.

2. The automatic door closing hinge according to claim 1, wherein the first cam groove and the second cam groove of the substantially V-shape are respectively formed continuously on the outer peripheral surface of the operating rod.

3. The automatic door closing hinge according to claim 1, wherein the difference of elevation between the upper and lower ends of the second cam groove is formed to be longer than the difference of elevation between the upper and lower ends of the first cam groove.

4. The automatic door closing hinge according to claim 1, wherein an air distribution hole is provided on a bottom portion of the piston, the air distribution hole includes a large diameter portion on the other end side of the cylinder, a small diameter portion on the one end side, and a valve plate between the large diameter portion and the small diameter portion, the valve plate is capable of forming a gap communicating from one end side to the other end side between the large diameter portion and the valve plate and closing the small diameter portion, and an adjustable screw portion being capable of adjusting the size of an air flow channel formed between a male thread and a female thread by the extent of screwing is provided at the other end of the cylinder.

5. A double swing door structure which allows opening and closing inward and outward comprising the automatic door closing hinge installed on a door supporting portion or on a door according to claim 1, wherein a receiving hinge to be attached to the automatic door closing hinge is installed on a door or a door supporting portion.

6. An automatic door closing hinge comprising:

a cylinder;

an operating rod attached to one end of the cylinder so as to be rotatable and restricted from moving in the longitudinal direction;

a first cam groove including two substantially V-shaped grooves formed on an outer peripheral surface of the operating rod in the cylinder so as to oppose to each other;

two first balls engaged respectively with the first cam groove so as to oppose to each other;

a compression ring engaged with the first balls and movable in the longitudinal direction in the cylinder in conjunction with the movement of the first balls with respect to the first cam groove;

a compression coil spring disposed between the compression ring and an upper end portion of the cylinder for urging the compression ring toward the other end of the cylinder;

a second cam groove including two substantially V-shaped grooves provided on the outer peripheral surface of the operating rod in the cylinder so as to oppose to each other and disposed under the first cam groove with upper and lower ends being aligned with those of the first cam groove in the longitudinal direction;

two second balls engaged respectively with the second cam groove and disposed so as to oppose to each other;

a piston engaged with the second balls and movable in the longitudinal direction in the cylinder in conjunction with the movement of the second balls with respect to the second cam groove; and an air damper unit configured to flow out air in the cylinder on the other end side with respect to a bottom portion of the piston gradually according to the movement of the piston toward the other end.

7. The automatic door closing hinge according to claim 6, wherein the first cam groove and the second cam groove of the substantially V-shape are respectively formed continuously on the outer peripheral surface of the operating rod.

8. The automatic door closing hinge according to claim 6, wherein the difference of elevation between the upper and lower ends of the second cam groove is formed to be longer than the difference of elevation between the upper and lower ends of the first cam groove.

9. The automatic door closing hinge according to claim 6, wherein an air distribution hole is provided on a bottom portion of the piston, the air distribution hole includes a large diameter portion on the other end side of the cylinder, a small diameter portion on the one end side, and a valve plate between the large diameter portion and the small diameter portion, the valve plate is capable of forming a gap communicating from one end side to the other end side between the large diameter portion and the valve plate and closing the small diameter portion, and an adjustable screw portion being capable of adjusting the size of an air flow channel formed between a male thread and a female thread by the extent of screwing is provided at the other end of the cylinder.

10. A double swing door structure which allows opening and closing inward and outward comprising the automatic door closing hinge installed on a door supporting portion or on a door according to claim 6, wherein a receiving hinge to be attached to the automatic door closing hinge is installed on a door or a door supporting portion.

* * * * *